US007310942B2

(12) United States Patent
Shiga et al.

(10) Patent No.: US 7,310,942 B2
(45) Date of Patent: Dec. 25, 2007

(54) EXHAUST PASSAGE CONTROL VALVE

(75) Inventors: Hiroyuki Shiga, Tokai (JP); Shouji Ichikawa, Aichi (JP); Tatsuhiro Nagashima, Ohta (JP); Hiroshi Ogura, Ohta (JP)

(73) Assignees: Chuo Hatsujo Kabushiki Kaisha, Nagoya (JP); Sakamoto Industry Co., Ltd., Ohta (JP)

( * ) Notice: Subject to any disclaimer, the term of this patent is extended or adjusted under 35 U.S.C. 154(b) by 0 days.

(21) Appl. No.: 11/320,570

(22) Filed: Dec. 30, 2005

(65) Prior Publication Data

US 2006/0150619 A1 Jul. 13, 2006

(30) Foreign Application Priority Data

Jan. 4, 2005 (JP) ..... 2005-000240

(51) Int. Cl.
*F01N 7/00* (2006.01)

(52) U.S. Cl. ..... 60/324; 60/292; 60/293; 60/312; 60/322; 181/237; 181/254; 181/278; 181/279; 137/529; 137/535; 123/65 V; 29/DIG. 85

(58) Field of Classification Search ..... 60/272, 60/292, 293, 312, 322, 323, 324; 181/237, 181/241, 254, 277, 278, 279; 137/529, 535; 123/65 PE, 65 EM, 65 V; 29/DIG. 85
See application file for complete search history.

(56) References Cited

U.S. PATENT DOCUMENTS 4,205,706 A * 6/1980 Jasensky ..... 137/468
6,176,347 B1 * 1/2001 Chae et al. ..... 181/254
6,338,246 B2 * 1/2002 Eguchi et al. ..... 60/324
6,527,006 B2 * 3/2003 Jackson ..... 137/527.6
6,637,449 B2 * 10/2003 Nagai et al. ..... 137/15.18
6,769,247 B2 * 8/2004 Watanabe et al. ..... 60/324

FOREIGN PATENT DOCUMENTS

JP 2001-207827 8/2001

* cited by examiner

*Primary Examiner*—Binh Q. Tran
(74) *Attorney, Agent, or Firm*—Oliff & Berridge, PLC

(57) ABSTRACT

Exhaust passage control valve 10 may comprise housing 30, valve member 20, and helical torsion spring 40. Housing 30 has an exhaust passage. Exhaust gas from an internal combustion engine flows through the exhaust passage of the housing 30. Valve member 20 opens and closes the exhaust passage of the housing. Helical torsion spring 40 may be disposed at the opposite side of the valve member from the housing side thereof. Helical torsion spring 40 comprises a coil part wherein spring wires have been wound in a coil shape, and arms formed at both ends of the coil part. The coil part may be disposed at approximately the center of the valve member. When the arms bend with respect to the coil part, the counter-force of this bending energizes the valve member towards a closing side. The spring mounting member may be arranged and constructed to adjust a position in which the spring mounting member is mounted on the housing such that a rotation angle of the arms can be changed.

9 Claims, 15 Drawing Sheets

EXHAUST PASSAGE CONTROL VALVE

CROSS REFERENCE

This application claims priority to Japanese patent application number 2005-240, filed Jan. 4, 2005, the contents of which are hereby incorporated by reference as if fully set forth herein.

BACKGROUND OF THE INVENTION

1. Field of the Invention

The present invention relates to an exhaust passage control valve disposed in an exhaust passage of an internal combustion engine (e.g., an engine of a vehicle). Specifically, the present invention relates to an exhaust passage control valve that opens when pressure of exhaust gas flowing through the exhaust passage is equal to or exceeds a predetermined level.

2. Description of the Related Art

An exhaust passage control valve is disposed in an exhaust passage of an internal combustion engine. The exhaust passage control valve opens when pressure of exhaust gas flowing through the exhaust passage is equal to or exceeds a predetermined level. For example, a muffler is disposed in an exhaust device of a vehicle engine. A bypass passage is formed within the muffler for reducing the airflow resistance, and the exhaust passage control valve is disposed within the bypass passage. When the pressure of the exhaust gas is high, the exhaust passage control valve opens, and engine output is thus increased. When the pressure of the exhaust gas is low, the exhaust passage control valve closes, and muffler performance thus improves.

Conventionally, a butterfly valve is used within this type of exhaust passage control valve. In butterfly valves, spring load increases as the degree of opening of the valve increases. As a result, even if the butterfly valve starts to open when the pressure of the exhaust gas reaches the predetermined level, the pressure of the exhaust gas must become considerably higher than the predetermined level for the butterfly valve to open fully. In order to deal with this problem, an exhaust passage control valve disclosed in Japanese Patent No. 3326746 has been proposed.

This exhaust passage control valve comprises a housing through which exhaust gas from the engine flows, a valve member mounted on the housing, and a helical torsion spring biasing the valve member towards the closing position. The helical torsion spring is disposed at the opposite side of the valve member from the housing side thereof. A coil part of the helical torsion spring is supported by a supporting part formed at approximately the center of the valve member. A center axis of the coil part is approximately parallel with a surface of the valve member. Arms of the helical torsion spring are supported in a spring mounting member. The arms of the helical torsion spring can be slid in a longitudinal direction with respect to the spring mounting member. The spring mounting member is fixed to the housing. When these components (i.e., housing, valve member, torsion coil member, and spring mounting member) have been assembled, the arms of the helical torsion spring change position by rotating with respect to the coil part. When the arms rotate, the arms bend with respect to the coil part. The valve member is biased towards the closing side by the bending counter-force of the arms.

With this exhaust passage control valve, when the valve member moves to an opening side, the arms of the helical torsion spring slide in the longitudinal direction with respect to the spring mounting member. When the arms slide with respect to the spring mounting member, there is a change in the distance from the center of the coil part to an arm mounting position (i.e., a change in the effective length of the arms). When the effective length of the arms increases, the bending counter-force of the arms becomes smaller. The exhaust passage control valve is set such that the effective length of the arms increases as the arms move towards the opening side. It is therefore possible to prevent an increase in the spring load with respect to the degree of opening of the valve. As a result, the valve fully opens rapidly when the pressure of the exhaust gas exceeds the predetermined level, and the valve is able to open sufficiently.

SUMMARY OF THE INVENTION

In the above mentioned exhaust passage control valve, the spring load when the valve starts to open is determined by a preliminary rotation angle of the arms of the helical torsion spring (i.e., the difference between the angle of the arms before being mounted and the angle of the arms after being mounted). The angle of the arms after being mounted is a constant value from the dimensions of the housing and the spring mounting member. As a result, the angle of the arms before being mounted must be controlled so that the spring load when the valve starts to open will be the desired value.

The manufacture of the helical torsion spring includes an aging treatment in a heat treatment step. The shape of the helical torsion spring (particularly the angle of the arms before being mounted) is changed by undergoing the heat treatment, and there is a large variation in the degree to which the heat treatment causes the shape to change. It is consequently difficult to increase the accuracy of shape of the helical torsion spring. In particular, since the helical torsion spring that is used in the exhaust passage control valve will be heated by hot exhaust gas (at, for example, 500~600° C.), particular materials such as inconel are used. Using this type of particular material leads to a greater variation in the degree to which the shape changes due to the heat treatment, and it is difficult to increase the accuracy of shape after the heat treatment.

It is, accordingly, one object of the present teachings to provide improved exhaust passage control valves wherein it is possible to set a desired valve opening load (i.e., a load when the valve starts to open) even if there is variation in the shape of a helical torsion spring.

In one aspect of the present teachings, an exhaust passage control valve may comprise a housing, a valve member, and a helical torsion spring. The housing may have an exhaust passage. The exhaust passage of the housing may be connected with an exhaust passage through which exhaust gas from an internal combustion engine flows. The valve member may open and close the exhaust passage of the housing. The helical torsion spring may be disposed at the opposite side of the valve member from the housing side thereof. The helical torsion spring may comprise a coil part wherein spring wires have been wound in a coil shape, and arms formed at both ends of the coil part. The coil part may be disposed at approximately the center of the valve member. When the arms bends with respect to the coil part, the counter-force of the bending arms biases the valve member towards a closing side. The exhaust passage control valve is arranged and constructed to adjust a valve opening load (i.e., a load when the valve starts to open) to a desired value.

In one embodiment of the present teachings, the exhaust passage control valve may include a spring mounting member mounted on the housing. The spring mounting member may be supported such that the arms of the helical torsion spring can be slid in a longitudinal direction with respect to the spring mounting member. The position in which the spring mounting member is mounted on the housing can be adjusted such that a rotation angle of the arms can be changed. By adjusting the position in which the spring mounting member is mounted on the housing, a valve opening load when the valve member starts to open can be adjusted to a desired value even if there is variation in the shape of the helical torsion spring.

In another embodiment of the present teachings, the housing may have a plurality of spring fitting holes which support the arms of the helical torsion spring such that the arms can be slid within the spring fitting holes in a longitudinal direction thereof. The rotation angle of the arms can be changed when the valve member is disposed in a closed position by changing which of the spring fitting holes has the arms mounted therein. A valve opening load when the valve starts to open can be adjusted to a desired value by changing the position in which the helical torsion spring is mounted.

Further, it is preferred that the arm mounting position (i.e. the position in which the arms are mounted on the spring mounting member, or the position of the spring fitting holes) when the valve member is disposed in the closed position is lower than an upper face of the coil part and is higher than a lower face of the coil part. The arm mounting position is set to be lower than the upper face of the coil part because, if the arm mounting position were higher than the upper face of the coil part, the effective length of the arms would become shorter as the valve member is moved toward the opening side, and there would be a large increase in the valve opening load as the degree of opening of the valve increases. The arm mounting position is set to be higher than the lower face of the coil part because, if the arm mounting position were lower than the lower face of the coil part, the arms would have to slide for a greater amount with respect to an arm mounting part (i.e., the spring mounting member, or the spring fitting holes).

Further, it is preferred that a metal mesh sheet is disposed at a sealing face of the housing and the valve member. With this type of configuration, a seal can be improved when the valve is closed, and hammering when the valve is closed can be suppressed.

Furthermore, a supporting part for supporting the coil part of the helical torsion spring may be formed at approximately the center of the valve member. It is preferred that a metal mesh sheet is disposed between the coil part and the supporting part. With this type of configuration, frictional resistance between the coil part and the supporting part can be reduced, and excessive hysteresis can be suppressed.

These aspects and features may be utilized singularly or, in combination, in order to make improved exhaust passage control valve. In addition, other objects, features and advantages of the present teachings will be readily understood after reading the following detailed description together with the accompanying drawings and claims. Of course, the additional features and aspects disclosed herein also may be utilized singularly or, in combination with the above-described aspect and features.

BRIEF DESCRIPTION OF THE DRAWINGS

FIG. 5(*a*) shows the exhaust passage control valve before adjusting the position, FIG. 5(*b*) shows the exhaust passage control valve after adjusting the position.

FIG. 9(*a*) is front view of the exhaust passage control valve, FIG. 9(*b*) is side view of the exhaust passage control valve.

FIG. 14(*a*) shows a state where the valve member is disposed in a maximum open position, FIG. 14(*b*) shows a state where the valve member is disposed in the closed position.

FIG. 15(*a*) shows a state where the valve member is disposed in the maximum open position, FIG. 15(*b*) shows a state where the valve member is disposed in the closed position.

FIG. 16(*a*) shows a state where the valve member is disposed in the maximum open position, FIG. 16(*b*) shows a state where the valve member is disposed in the closed position.

FIG. 20(*a*) shows an example of the present teachings, FIG. (20*b*) shows another example of the present teachings.

FIG. 23(*a*) shows the exhaust passage control valve before covered by the punching metal, FIG. 23(*b*) shows the exhaust passage control valve after covered by the punching metal.

FIG. 24(*a*) shows perspective view of the exhaust passage control valve, FIG. 24(*b*) shows an enlarged view of the valve member.

DETAILED DESCRIPTION OF THE INVENTION

First Detailed Representative Embodiment

An exhaust passage control valve of the first representative embodiment will be described in detail with reference to the drawings. As shown in FIGS. 1~4, the exhaust passage control valve is provided with housing 30 formed from a tubular pipe. A lower end of housing 30 (i.e., an exhaust pipe connecting end) is connected with an exhaust gas passage through which gas flows that is being emitted from an engine of a vehicle. The exhaust gas flowing along the exhaust gas passage is led into housing 30. An upper end (i.e., an exhaust end) of housing 30 is closed in a manner allowing opening and closing by valve member 20.

Figure 1:
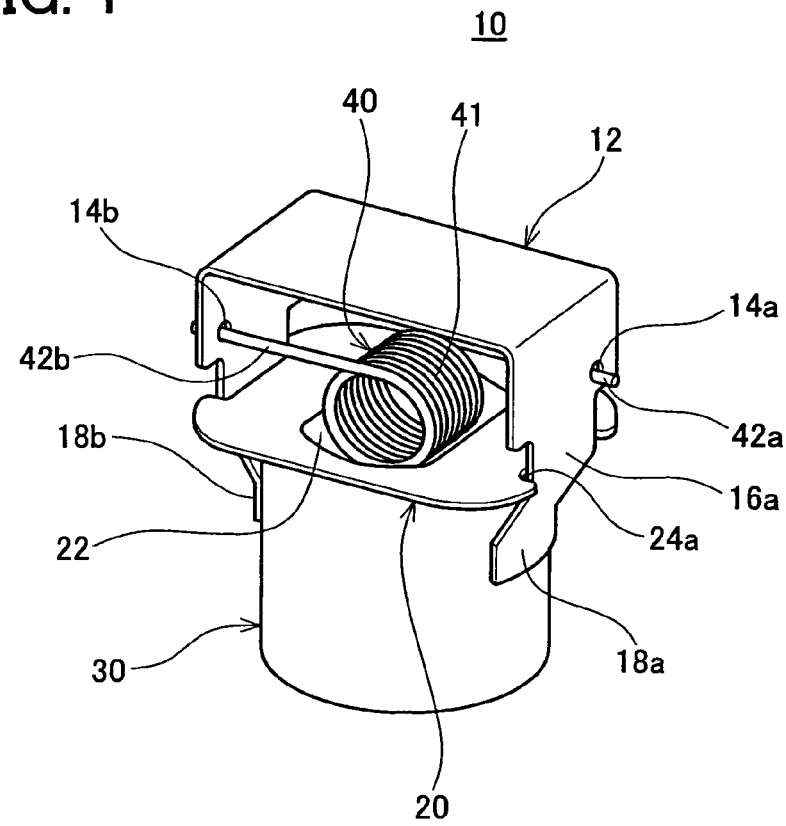
FIG. 1 is a perspective view of an exhaust passage control valve according to a first representative embodiment when a valve member is disposed in a closed position.
Figure 2:
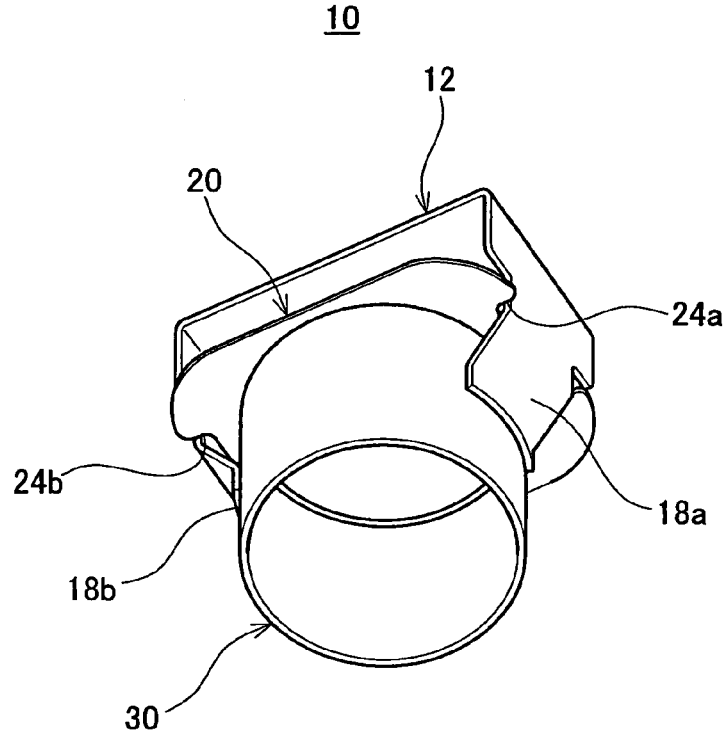
FIG. 2 shows a perspective view of the exhaust passage control valve of the first representative embodiment viewed from a different direction.
Figure 3:
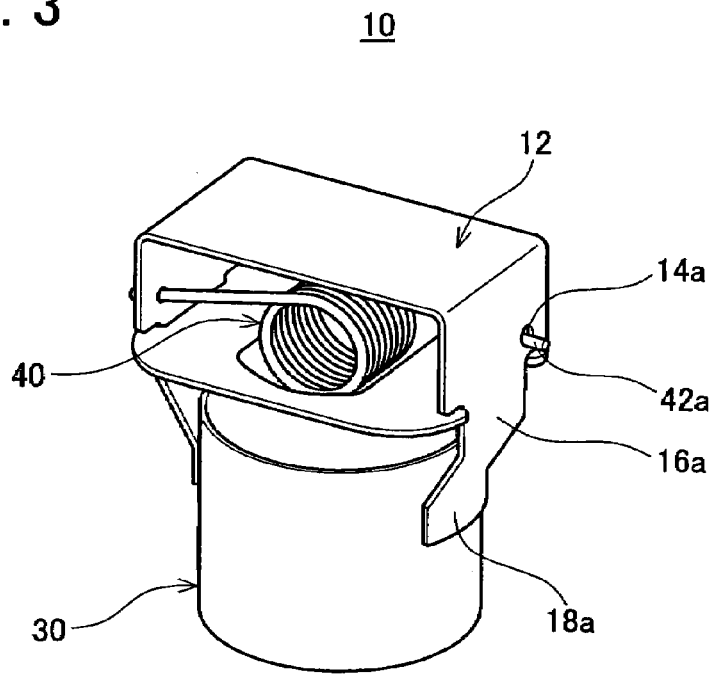
FIG. 3 shows a perspective view of the exhaust passage control valve of the first representative embodiment when the valve member is disposed in an open position.
Figure 4:
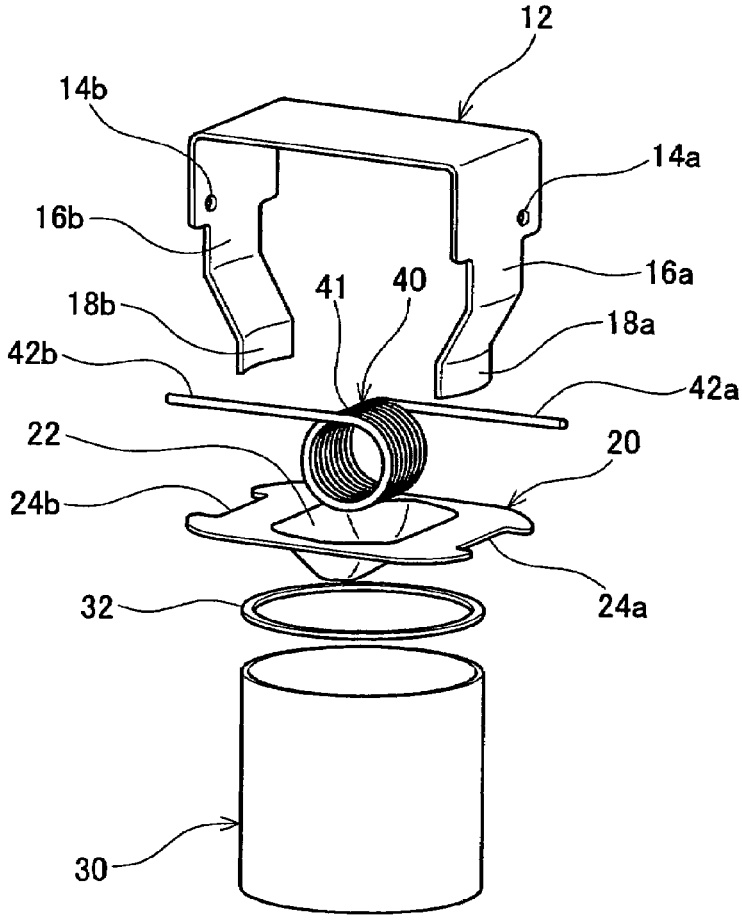
FIG. 4 is a disassembled perspective view of the exhaust passage control valve of the first representative embodiment.

Valve member 20 is a molded sheet that has been manufactured by press molding. As shown in FIG. 4, valve member 20 has spring supporting part 22 formed at the center of valve member 20, and a pair of grooves 24*a* and 24*b* formed at positions facing an outer periphery of spring supporting part 22. Spring supporting part 22 is formed as a concave that protrudes toward housing 30. Spring supporting part 22 has a shape corresponding to the shape of coil part 41 of helical torsion spring 40.

A ring-shaped metal mesh sheet 32 is fixed by spot welding to an inner face (i.e., a face at the housing side) of valve member 20. Metal mesh sheet 32 formed from metal wires that have been woven into mesh, and has a certain resilience. Stainless steel wire, for example, can be used for the metal mesh sheet. Alternatively, a sintered porous metal plate, a graphite and metal wire composite, a sheet made from ceramic fibers, etc. can be used as the metal mesh sheet. When valve member 20 closes the upper end of housing 30, metal mesh sheet 32 makes contact with a sealing face of housing 30. Since metal mesh sheet 32 is resilient, the seal provided by metal mesh sheet 32 is improved, and hammering between valve member 20 and housing 30 when valve member 20 is closed can be prevented.

Helical torsion spring 40 is disposed on valve member 20 at the opposite side thereof from the housing side. Helical torsion spring 40 is provided with coil part 41 in which spring wire has been wound in a coil shape, and arms 42*a* and 42*b* that are formed at both ends of coil part 41. Coil part 41 is supported in spring supporting part 22 of valve member 20. When an outer circumference of coil part 41 is being supported in spring supporting part 22, a center axis of coil part 41 is approximately parallel with a surface of valve member 20 (i.e., with an upper face of valve member 20).

Arms 42*a* and 42*b* fit with fitting holes 14*a* and 14*b* respectively formed in spring mounting member 12. Arms 42*a* and 42*b* can be slid in a longitudinal direction with respect to fitting holes 14*a* and 14*b*.

Spring mounting member 12 has guiding parts 16*a* and 16*b* for guiding valve member 20, and fixing parts 18*a* and 18*b* that connect with lower edges of the guiding parts 16*a* and 16*b*. When spring mounting member 12 has been fixed to housing 30, the guiding parts 16*a* and 16*b* guide the grooves 24*a* and 24*b* of valve member 20. Valve member 20 moves from the closed position shown in FIG. 1 to the maximum open position shown in FIG. 3 while being guided by the guiding parts 16*a* and 16*b*. In the maximum open state shown in FIG. 3, an upper face of valve member 20 makes contact with spring mounting member 12, thus preventing valve member 20 from moving further in the opening direction.

The fixing parts 18*a* and 18*b* are fixed to housing 30 by welding. When the fixing parts 18*a* and 18*b* are fixed to housing 30 while helical torsion spring 40 is in a state of being fitted in spring mounting member 12, the arms 42*a* and 42*b* bend in a rotating direction, and valve member 20 is energized towards the closing side by the bending counter-force of the arms 42*a* and 42*b*. The pressing force exerted on valve member 20 by helical torsion spring 40 can be adjusted by adjusting the position in which spring mounting member 12 is fitted to housing 30.

Figure 5:
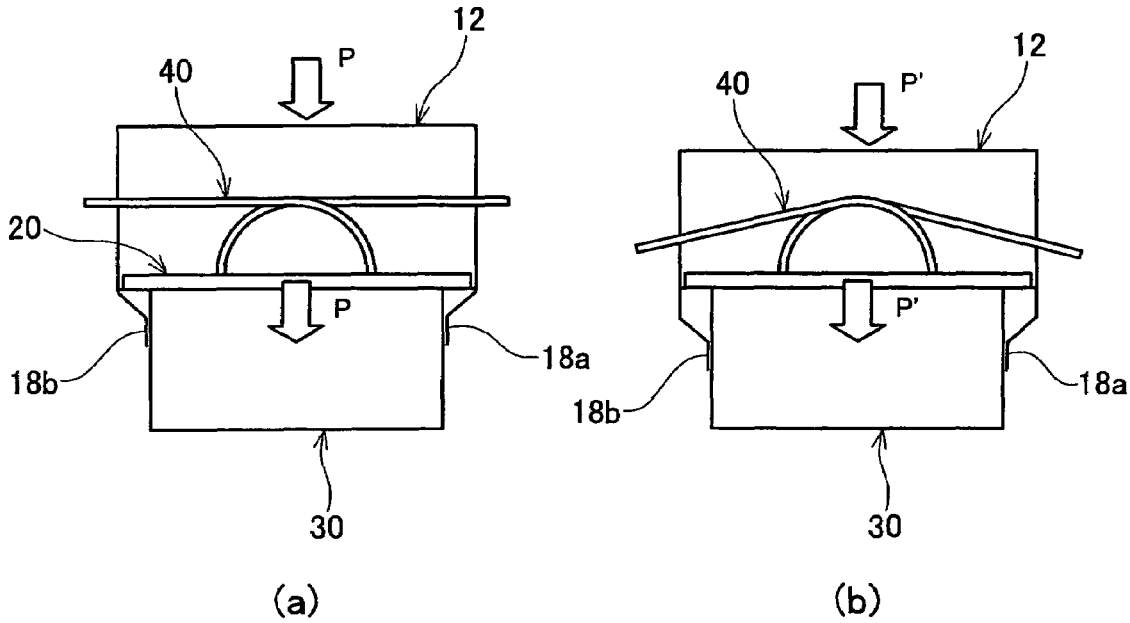
FIG. 5 schematically shows a method of adjusting a position in which a mounting member is mounted on a housing.

To mount spring mounting member 12 on housing 30, firstly, as shown in FIG. 5(*a*), valve member 20 is mounted on housing 30 and simultaneously helical torsion spring 40 is mounted on spring mounting member 12. Then, as shown in FIG. 5(*b*), an operating force P' is applied to spring mounting member 12, and spring mounting member 12 is slid from the top to the bottom of housing 30. The operating force P' applied to spring mounting member 12 balances the counter-force from the helical torsion spring 40. Further, the operating force P' is identical with the pressing force P' exerted on valve member 20 by helical torsion spring 40. As a result, spring mounting member 12 is moved downward while measuring the operating force P' applied to spring mounting member 12, and the fixing parts 18*a* and 18*b* are fixed to housing 30 when the operating force P' reaches a desired value. Helical torsion spring 40 can be set to have a desired set load by using this attaching method. Valve member 20 can thus be set to open when the pressure of the exhaust gas is reached to a predetermined value.

In the above exhaust passage control valve, valve member 20 closes the exhaust end of housing 30 when the pressure of the exhaust gas flowing through the interior of housing 30 is below the predetermined value. When the pressure of the exhaust gas rises above the predetermined value, valve member 20 opens the exhaust end of housing 30. When valve member 20 moves in an opening direction, the arms 42*a* and 42*b* of helical torsion spring 40 slide with respect to spring mounting member 12, and a load applying radius of the arms 42*a* and 42*b* increases. As a result, it is possible to prevent there being an increase in the load of opening the valve as the amount of movement of the valve member (the degree of opening) increases. Here, the load applying radius is the distance from a center of the coil part to a mounting position of the arm of the helical torsion spring.

Figure 6:
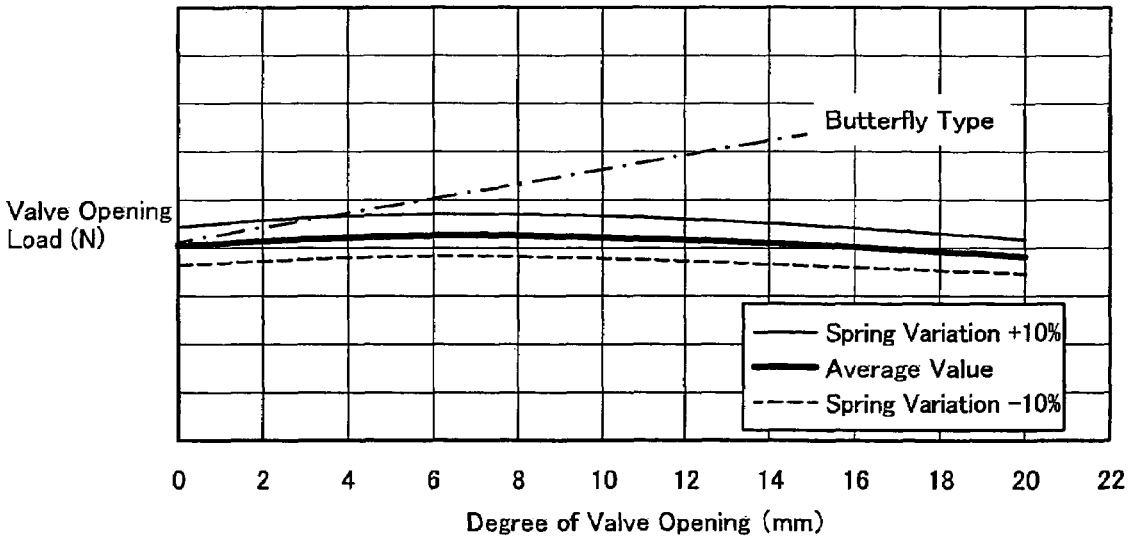
FIG. 6 is a graph showing the relationship between the degree of opening of the valve and the valve opening load of the exhaust passage control valve of the first representative embodiment.

FIG. 6 is a graph showing the relationship between the degree of opening of the valve and the load of opening the valve. For comparison, the figure shows results measured for a butterfly type exhaust passage control valve, and effects caused by error in the shape of the spring (results when the position of spring mounting member 12 has not been adjusted). As is clear from FIG. 6, in the exhaust passage control valve of the first representative embodiment, it is possible to prevent there being an increase in the load of opening the valve as the degree of opening increases. As a result, valve member 20 opens rapidly when the pressure of the exhaust gas exceeds the predetermined value, and it is possible to obtain a sufficient degree of opening.

Further, as shown in the figure, there is a deviation from the desired characteristics concerning 'degree of valve opening—load for valve opening' (the desired characteristics are shown by the central value in the figure) if there is an error in the shape of the spring. However, in the first representative embodiment, the desired 'degree of valve opening—load for valve opening' can be set by adjusting the position at which spring mounting member 12 is mounted on housing 30.

As is clear from the above, with the exhaust passage control valve of the first representative embodiment, it is possible to set the desired 'degree of valve opening—load for valve opening' by adjusting the position at which spring mounting member 12 is mounted on housing 30 even if there is an error in the shape of helical torsion spring 40.

Moreover, in the first representative embodiment, valve member 20 is molded in a unified manner as a molded sheet, and consequently the strength thereof can be increased, this causing a reduction in vibration and an increase in durability and reliability. Further, helical torsion spring 40 is supported in spring supporting part 22 in valve member 20, and consequently the number of components can be reduced and low cost manufacturing is possible.

Furthermore, helical torsion spring 40 is disposed on valve member 20 at the opposite side thereof from the housing side. Consequently helical torsion spring 40 is not exposed directly to the hot exhaust gas, and therefore heat fatigue of the spring is reduced.

Second Detailed Representative Embodiment

Figure 7:
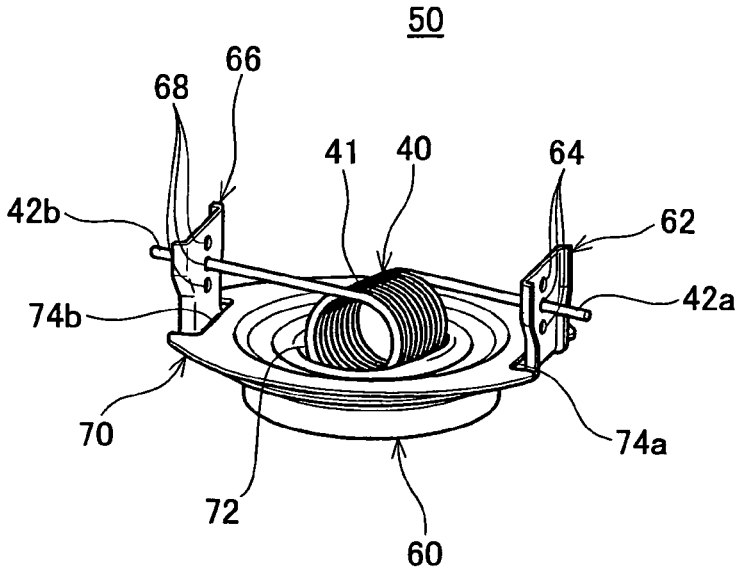
FIG. 7 is a perspective view of a exhaust passage control valve of a second representative embodiment when a valve member is disposed in a closed position.
Figure 8:
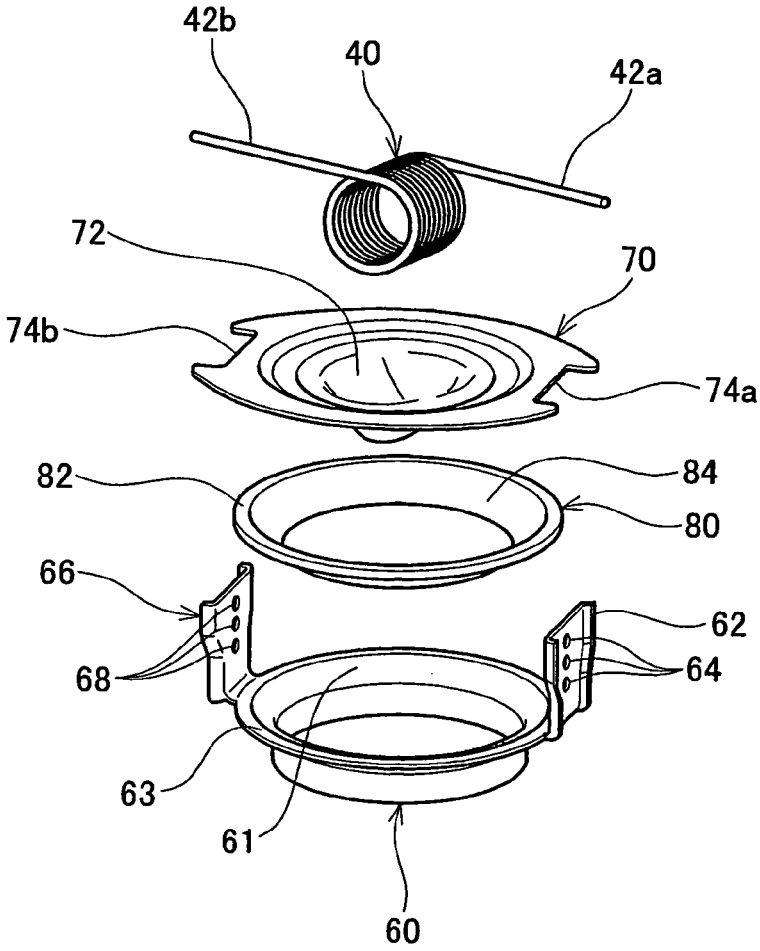
FIG. 8 is a disassembled perspective view of the exhaust passage control valve of the second representative embodiment.

An exhaust passage control valve of the second representative embodiment will now be described. As shown in FIGS. 7 and 8, the exhaust passage control valve of the second representative embodiment comprises housing 60. Housing 60 has spring mounts 62 and 66. Spring mounts 62 and 66 each have three fitting holes 64 and 68 respectively. Arms 42*a* and 42*b* of helical torsion spring 40 are each fitted into one of the fitting holes 64 and 68. The mounting position of arms 42*a* and 42*b* can thus be adjusted, and consequently it is possible to select the pressing force exerted on valve member 20 by helical torsion spring 40 and the characteristics concerning 'degree of valve opening—load for valve opening'.

Figure 9:
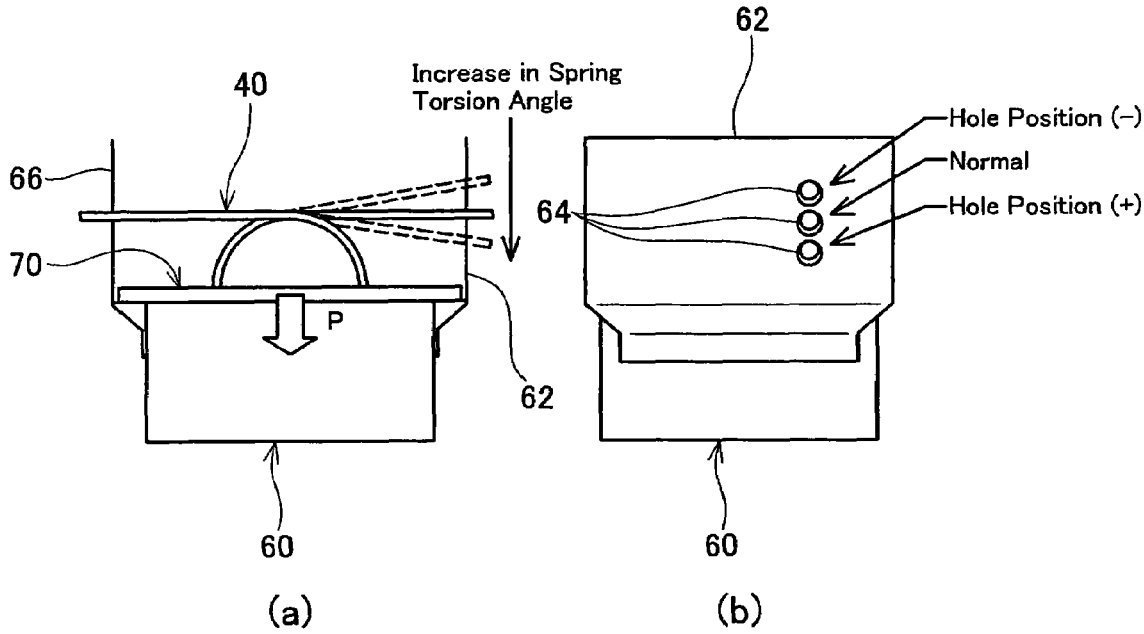
FIG. 9 schematically shows the relationship between the spring mounting position and the angle of arms of a helical torsion spring.

FIG. 9 shows the torsion angle of arm 42*a* (and 42*b*) when arm 42*a* (42*b*) of helical torsion spring 40 is fitted into each of the fitting holes 64 (68). As shown in FIG. 9, the torsion angle of arm 42*a* (42*b*) increases when arm 42*a* (42*b*) is moved downwards in the various fitting holes 64.

Figure 10:
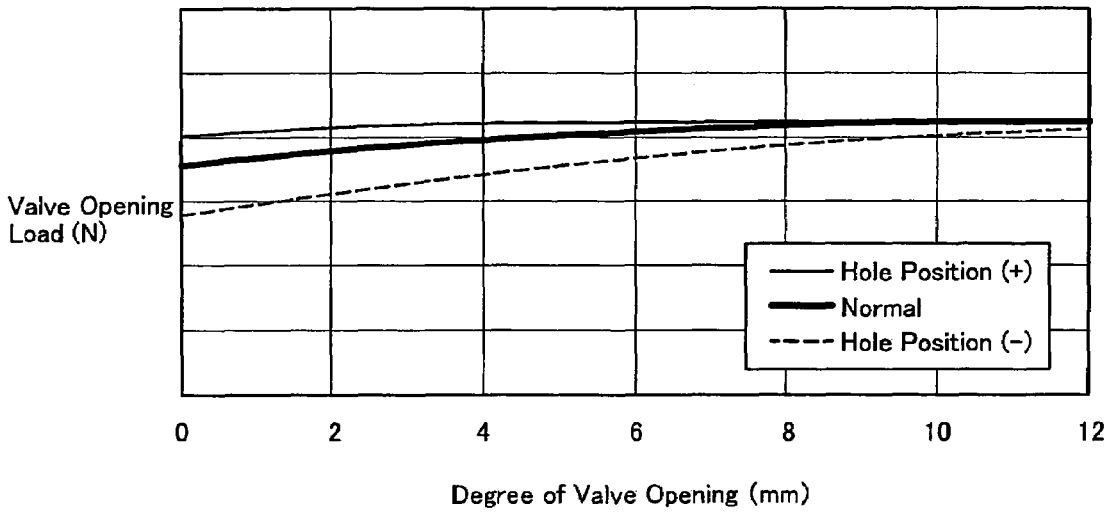
FIG. 10 shows characteristics of 'degree of valve opening—valve opening load' when a fitting hole position is changed.

FIG. 10 shows the characteristics of 'degree of valve opening—load for valve opening' at each of the spring fitting hole positions. When the position of the spring fitting hole is at an upper (−) side, the valve opening load when the valve opens can be lower. However, the load applying radius becomes shorter as the degree of valve opening increases, and consequently a gradual increase in the valve opening load is shown. When the position of the spring fitting hole is at a center (regular) position, the valve opening load when the valve opens becomes higher, but the load applying radius becomes longer as the degree of valve opening increases, and consequently an increase in the valve opening load can be suppressed. When the position of the spring fitting hole is at a lower (+) side, the aforementioned trend is more marked. By changing the position of the fitting hole 64 (68), it is thus possible to select the valve opening load when the valve opens and the characteristics concerning the 'degree of valve opening—load for valve opening'.

Flange 63 with a wide diameter is formed at an upper edge (an exhaust end) of housing 60. Flange 63 makes contact with a lower face of valve member 70. Metal mesh sheet 80 is fixed to housing 60. Metal mesh sheet 80 is provided with a seal part 82 that makes contact with Flange 63 of housing 60, and a welded part 84 that makes contact with a wide diameter part 61 (an r-shaped part) of housing 60. Metal mesh sheet 80 is welded to housing 60 at the welded part 84, and is not welded at the seal part 82. That is, indentations or weakness that occur at the welded positions cause a decrease in buffer performance or a worsening of the seal. Thus, an improvement in the seal and maintenance of buffer performance are obtained by not welding the seal part 82 that seals a sealing face of housing 60 and valve member 70.

Valve member 70 has a spring supporting part 72 formed at an upper face of valve member 70, and grooves 74*a* and 74*b* formed in an outer periphery of valve member 70. Grooves 74*a* and 74*b* are guided onto spring mounts 62 and 66, and valve member 70 is slid from a closed state to an open state.

As is clear from the above, in the exhaust passage control valve of the second representative embodiment, a plurality of spring fitting holes 64 and 68 are formed in spring mounts 62 and 66 of housing 60. As a result, it is possible to use the identical helical torsion spring to realize differing valve opening loads when the valve opens and differing characteristics concerning the 'degree of valve opening—load for valve opening'. Further, even if there is an error in the shape of the helical torsion spring, the valve opening load when the valve opens and the characteristics concerning the 'degree of valve opening—load for valve opening' can be kept within an allowed range by selecting which of the spring fitting holes 64 and 68 will be used.

Moreover, the number of components has been further reduced in the second representative embodiment, and consequently manufacturing costs can be reduced.

As is clear from the description of the above embodiments, the force which the helical torsion spring applies to the valve member can be changed by changing a spring mounting position. This is because the direction of the load created by the helical torsion spring is different from the direction of the force applied to the valve member by the helical torsion spring.

Figure 11:
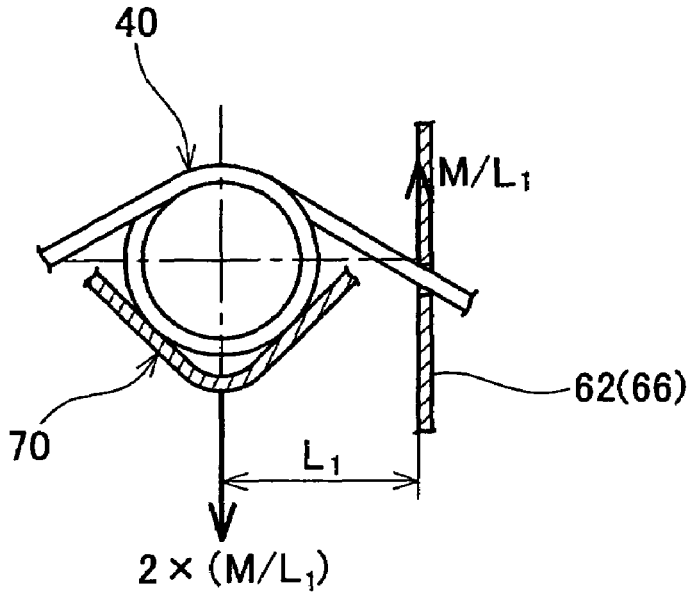
FIG. 11 shows an example of the relationship between moment exerted on the arms and pressing force exerted on a valve member.
Figure 12:
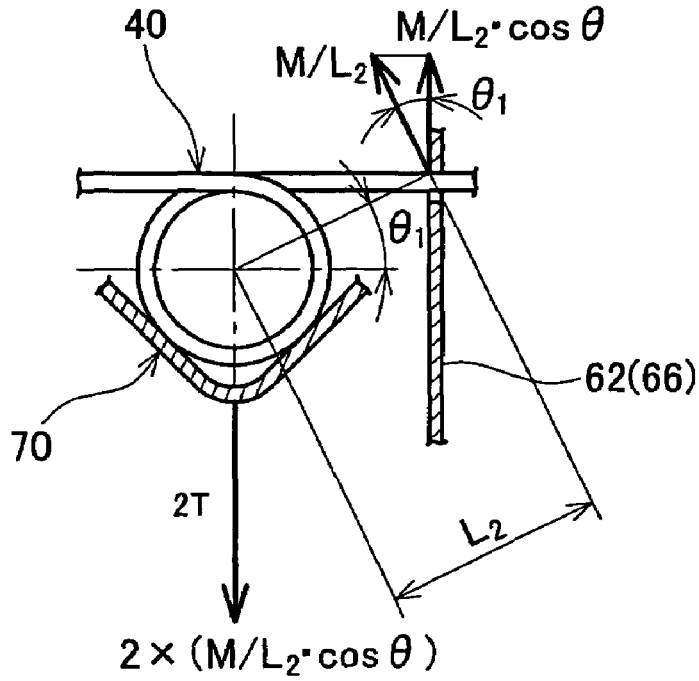
FIG. 12 shows a different example of the relationship between the moment exerted on the arms and pressing force exerted on the valve member.

For example, if the spring fitting hole is at the same height as the center of the coil part of the helical torsion spring, as shown in FIG. 11, the torque applied to the arms is in the same direction as the force applied to valve member 70 by the helical torsion spring. By contrast, if the spring fitting hole is at the same height as an upper face of the coil part of the helical torsion spring, as shown in FIG. 12, the torque applied to the arms differs from the direction of the force applied to valve member 70 by the helical torsion spring by an angle θ of the arms. Consequently, in the second representative embodiment, it is important to decide the position of the spring fitting holes.

Figure 13:
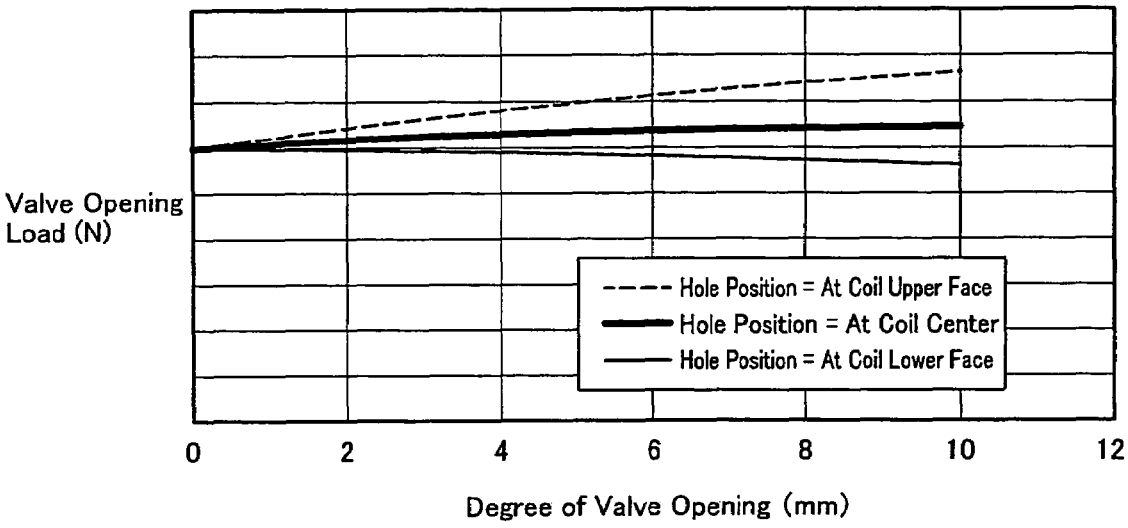
FIG. 13 shows characteristics of the 'degree of valve opening—valve opening load' when a fitting hole position is changed.

FIG. 13 shows the characteristics of 'degree of valve opening—load for valve opening' for the case where the spring fitting hole is at the same height as the upper face of the coil part of the helical torsion spring, the case where the spring fitting hole is at the same height as the center of the coil part of the helical torsion spring, and the case where the spring fitting hole is at the same height as a lower face of the coil part of the helical torsion spring (here, the position of the helical torsion spring when the valve is closed (a set position) is used as the norm).

Figure 16:
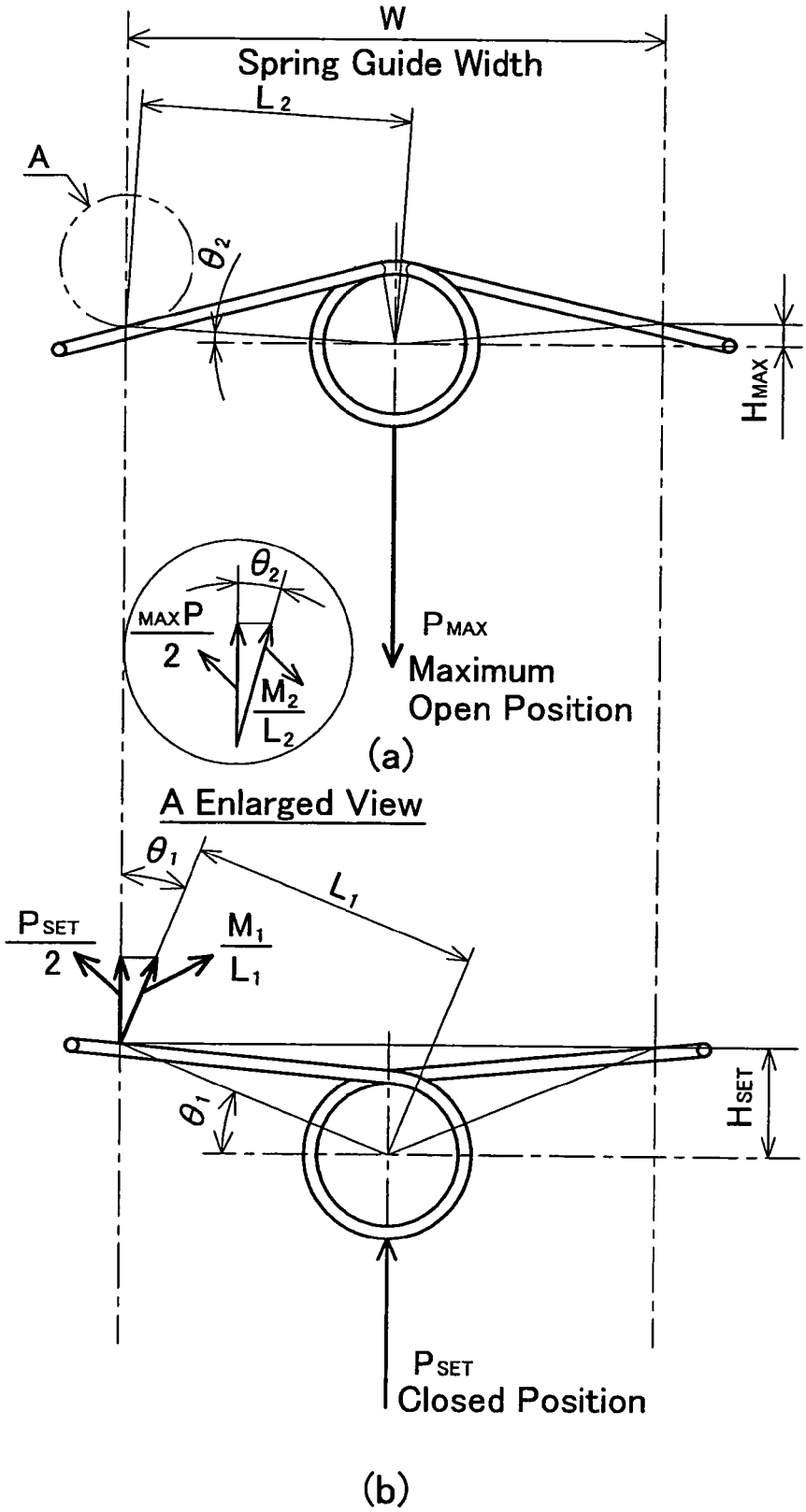
FIG. 16 shows the relationship between the direction of torque from the arms exerted on the housing and the counter-force from the torsion coil member exerted on the valve member when the position of the spring fitting hole is at the height of an upper face of the helical torsion spring.

As is clear from FIG. 13, when the position of the spring fitting hole is at the same height as the upper face of the helical torsion spring, the load applying radius becomes shorter as the degree of valve opening increases, and consequently there is a marked increase in the valve opening load. FIG. 16 shows the relationship for this case between the direction of the load applied to the housing by the arms of the helical torsion spring, and the counter-force applied on the valve member by the helical torsion spring. FIG. 16(*a*) shows a state where the valve member has been opened maximally, and FIG. 16(*b*) shows a state where the valve member has been closed. As is clear from the comparison between FIG. 16(*a*) and (*b*), the length of the arms protruding from the spring fitting hole increases as the degree of valve opening increases, and the load applying radius becomes shorter.

Figure 15:
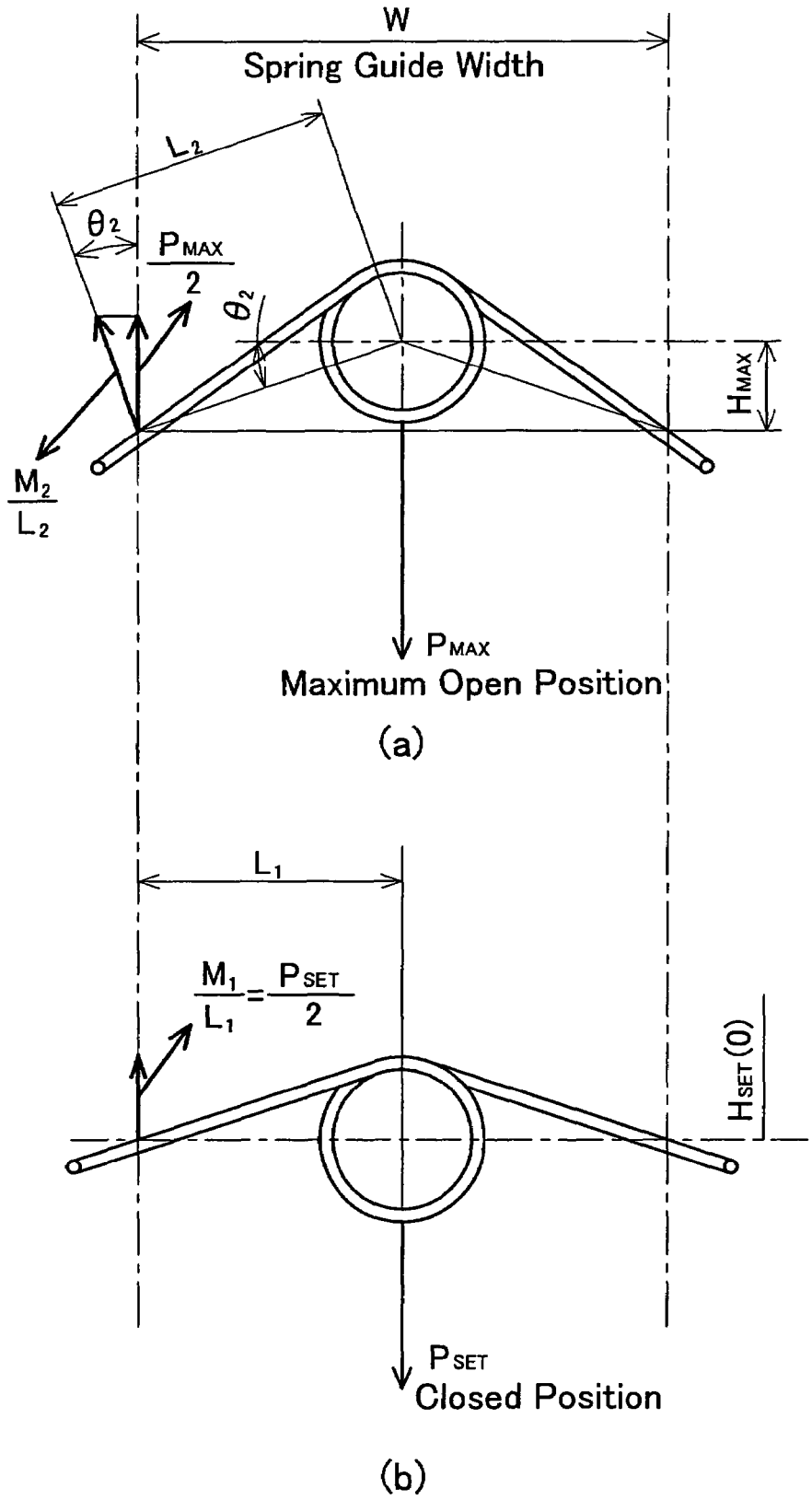
FIG. 15 shows the relationship between the direction of torque from the arms exerted on the housing and the counter-force from the helical torsion spring exerted on the valve member when the position of the spring fitting hole is at the height of a center of the helical torsion spring.

When the spring fitting hole is at the same height as the center of the helical torsion spring, the load applying radius becomes somewhat longer as the degree of valve opening increases, and consequently it is possible to suppress an increase in the valve opening load. FIG. 15 shows the relationship for this case between the direction of the load applied to the housing by the arms of the helical torsion spring, and the counter-force applied on the valve member by the helical torsion spring. FIG. 15(*a*) shows a state where the valve member has been opened maximally, and FIG. 15(*b*) shows a state where the valve member has been closed. As is clear from the comparison between FIG. 15(*a*) and (*b*), the length of the arms protruding from the spring fitting hole decreases as the degree of valve opening increases, and the load applying radius becomes longer.

Figure 14:
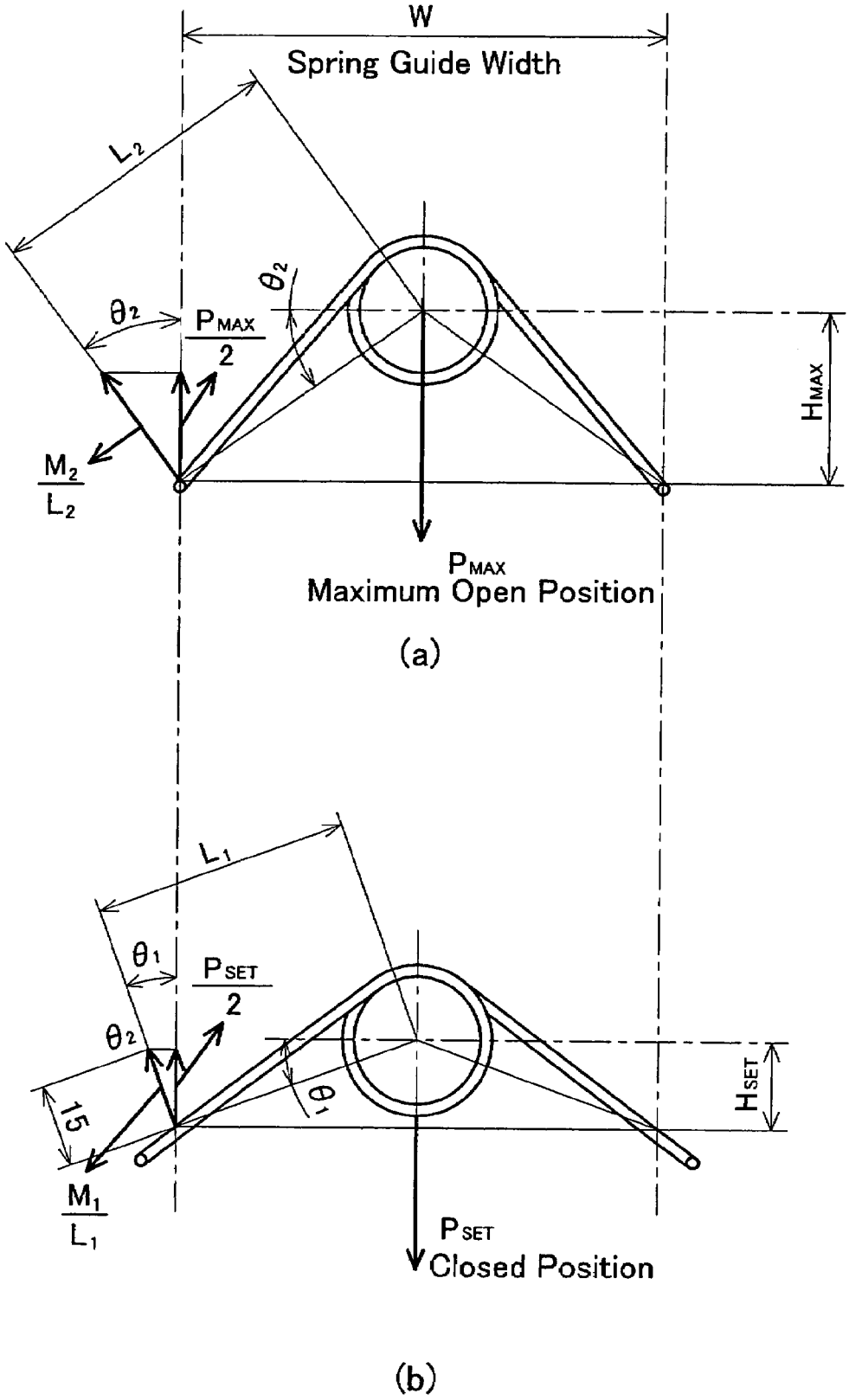
FIG. 14 shows the relationship between the direction of torque from the arms exerted on the housing and the counter-force from the helical torsion spring exerted on the valve member when the position of the spring fitting hole is at the height of a lower face of the helical torsion spring.

When the spring fitting hole is at the same height as the lower face of the helical torsion spring, the load applying radius becomes much longer as the degree of valve opening increases, and conversely the valve opening load decreases. For this case, FIG. 14 shows the relationship between the direction of the load applied to the housing by the arms of the helical torsion spring, and the counter-force applied on the valve member by the helical torsion spring. FIG. 14(*a*) shows a state where the valve member has been opened maximally, and FIG. 14(*b*) shows a state where the valve member has been closed. As is clear from the comparison between FIGS. 14(*a*) and (*b*), the length of the arms protruding from the spring fitting hole decreases as the degree of valve opening increases, and the load applying radius becomes longer. Further, as is clear from the comparison between FIG. 14 and FIG. 15, the load applying radius becomes much longer in the case shown in FIG. 14 as the degree of valve opening increases. As a result, it is arranged that the valve opening load will decrease as the degree of valve opening increases, as shown in FIG. 13.

As is clear from the above description, when the position of the spring fitting hole is changed, the amount by which the arms slide with respect to the spring fitting hole also changes when the valve member is moved to be opened maximally. When the amount by which the arms slide increases, there is a corresponding increase in frictional loss, and hysteresis also increases. Although moderate hysteresis is useful for reducing vibration, etc., excessive hysteresis can lead to it being impossible to fully close the valve member.

Figure 17:
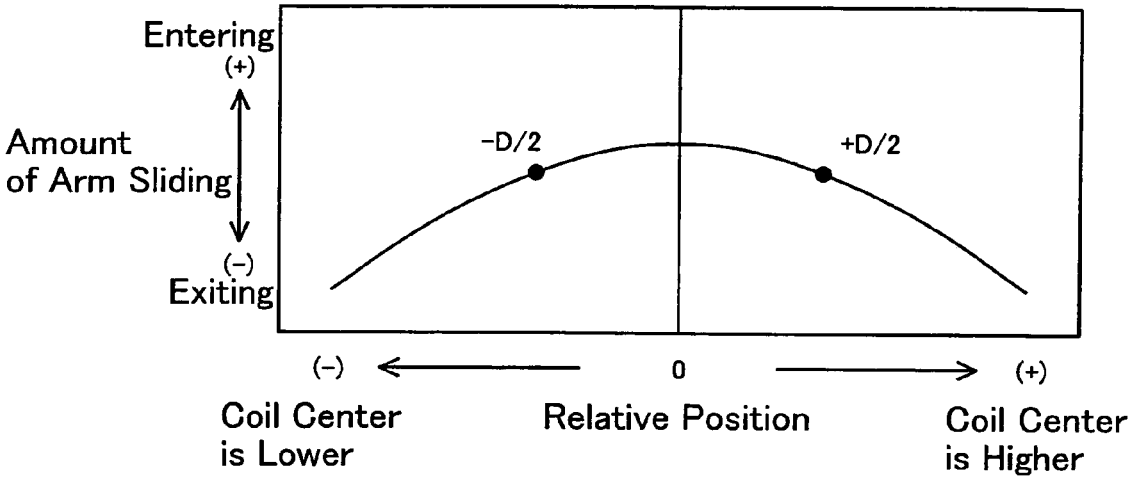
FIG. 17 schematically shows the relationship between the spring fitting hole position and the length of the arms protruding from the spring fitting hole at that position.

FIG. 17 schematically shows the relationship between the position of the center of the coil part with respect to the spring fitting hole and the length by which the arms protrude to an outer side from the spring fitting hole. The direction in which the length increases of the arms protruding to the outer side from the spring fitting hole is shown as (+), and the direction in which the length decreases of the arms protruding to the outer side from the spring fitting hole is shown as (−).

As is clear from FIG. 17, the arms protrude most from the spring fitting hole when the center of the coil part of the helical torsion spring is at the same height as the spring fitting hole. As the center of the coil part moves away from the position of the spring fitting hole, the arms protrude less from the spring fitting hole. As a result, the amount by which the arms slide can be reduced when the center of the helical torsion spring is in a range from +D/2 to −D/2 from the spring fitting hole (D being the coil radius of the helical torsion spring).

Figure 18:
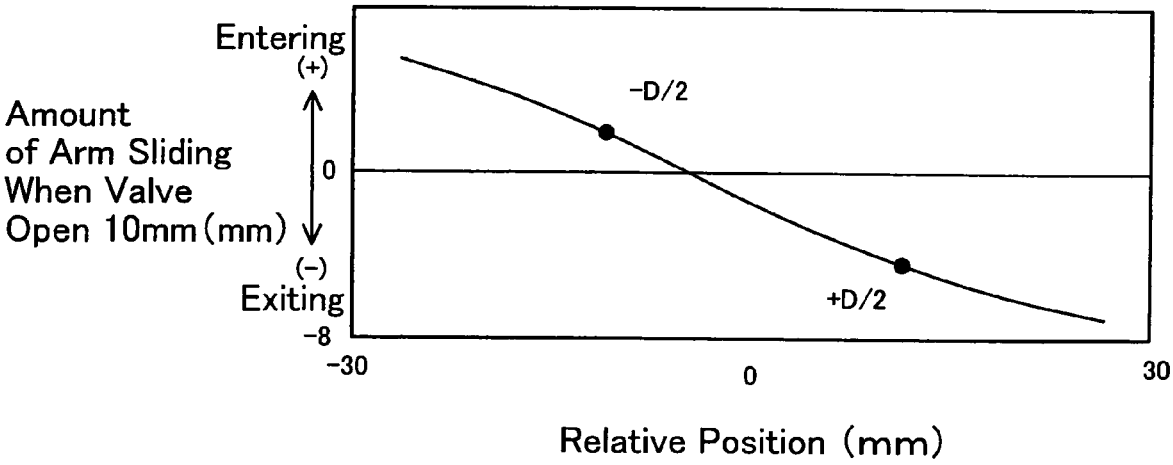
FIG. 18 shows the relationship between the spring fitting hole position, when set, and the amount of sliding of the arms when the spring has been set in that position and the valve has been maximally opened.

FIG. 18 shows the relationship between the position of the spring fitting hole and the amount of sliding of the arms when the valve member moves from the closed state to the maximally open state. The position of the center of the coil part, when set, with respect to the spring fitting hole is on the horizontal axis, and the amount of sliding of the arms when the valve is maximally open is on the vertical axis. The amount of sliding of the arms when the valve member moves from the closed state to the maximally open state is calculated as follows: letting the arms protrude by 5 mm, for example, to the outer side from the spring fitting hole in the closed state, the amount of sliding of the arms is +5 mm if the arms protrude by 10 mm to the outer side from the spring fitting hole when the valve member is in the maximally open state.

As is clear from FIG. 18, when the center of the coil part is below the fitting hole position that has been set (to the left of a relative position 0 in the figure), the length by which the arms protrude increases when the valve member is moved from the closed state to the maximally opened state. By contrast, when the center of the coil part is above the fitting hole position that has been set (to the right of the relative position 0 in the figure), the length by which the arms protrude decreases when the valve member is moved from the closed state to the maximally opened state. If there is too great a decrease in the length by which the arms protrude, there is the danger that the arms will come out of the spring fitting holes, and will not be able to be used.

From these results, it is preferred that the position of the spring fitting holes, when set, is lower than the upper face of the coil part of the helical torsion spring, and is higher than the lower face of the coil part.

Figure 19:
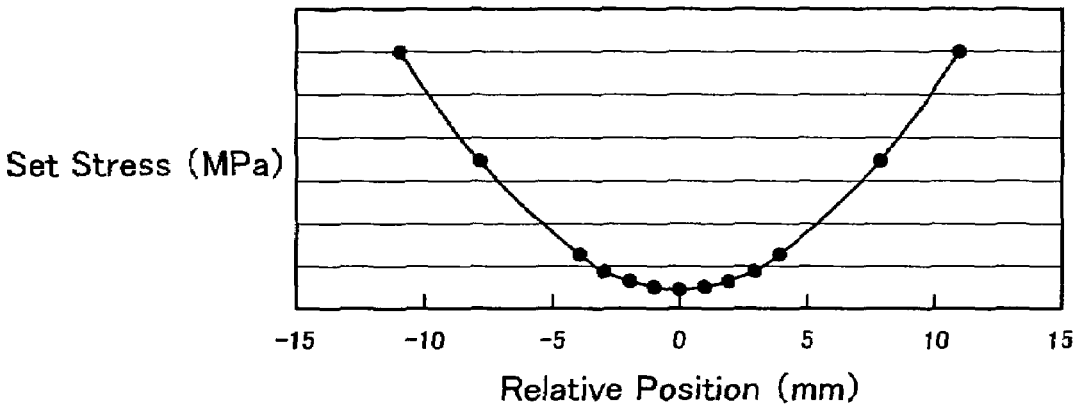
FIG. 19 shows the relationship between the spring fitting hole position, when set, and stress exerted on spring wires when set.

The position of the spring fitting holes, when set, also influences the stress exerted on the wires of the helical torsion spring. FIG. 19 shows the relationship between the position of the spring fitting holes, when set, and the stress exerted on the spring wires when set. FIG. 19 shows stress values at each of the spring fitting holes when the set load has been adjusted to a desired value. As shown in FIG. 19, the stress decreases when the position of the spring fitting holes, when set, is at the height of the center of the spring, and the stress increases as distance from the center of the spring increases. This is because the moment applied to the spring can be utilized less effectively as pressure for pressing the valve member as the position of the spring fitting holes that have been set grows further from the center of the spring. As the stress exerted on the spring wire increases, there are problems with durability or fatigue of the spring. As a result, from the viewpoint of stress, also, it is preferred that the position of the spring fitting holes, when set, is close to the height of the center of the spring.

Figure 20:
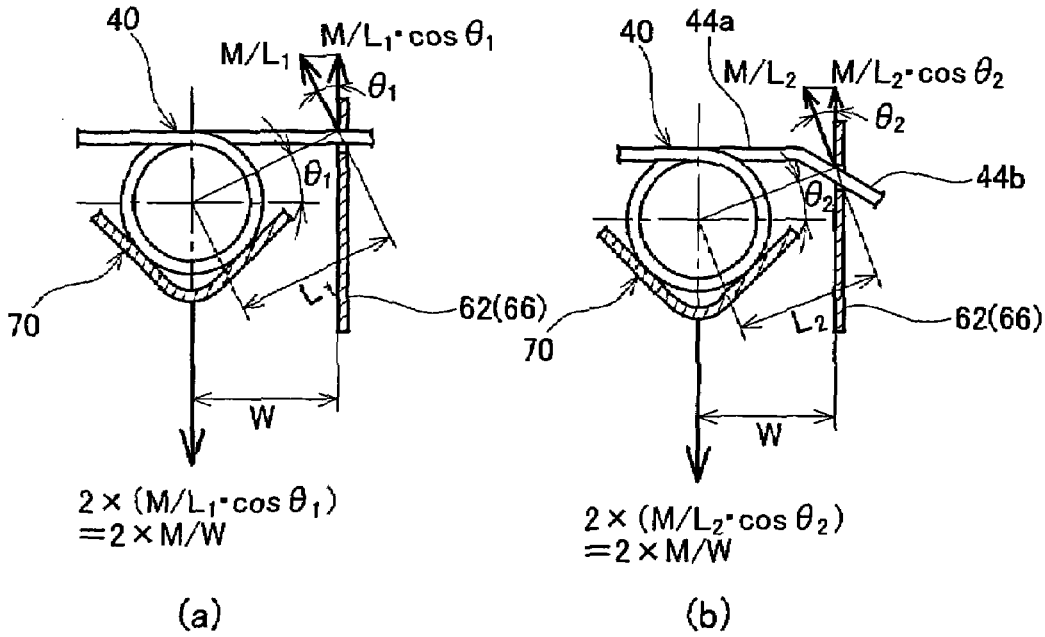
FIG. 20 is a figure for describing a variant of the exhaust passage control valve of the preset teachings.

In the representative embodiments described above, the explanation was given using, as an example, the arms of the helical torsion spring are straight. However, the present teachings are not restricted to this form. For example, as shown in FIG. 20(*b*), a helical torsion spring with curved arms can be used if the position of the spring fitting holes is restricted.

Figure 21:
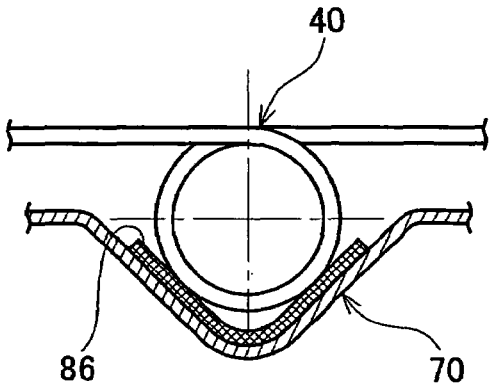
FIG. 21 is a figure for describing reduction in hysteresis in the variant shown in FIG. 20.
Figure 22:
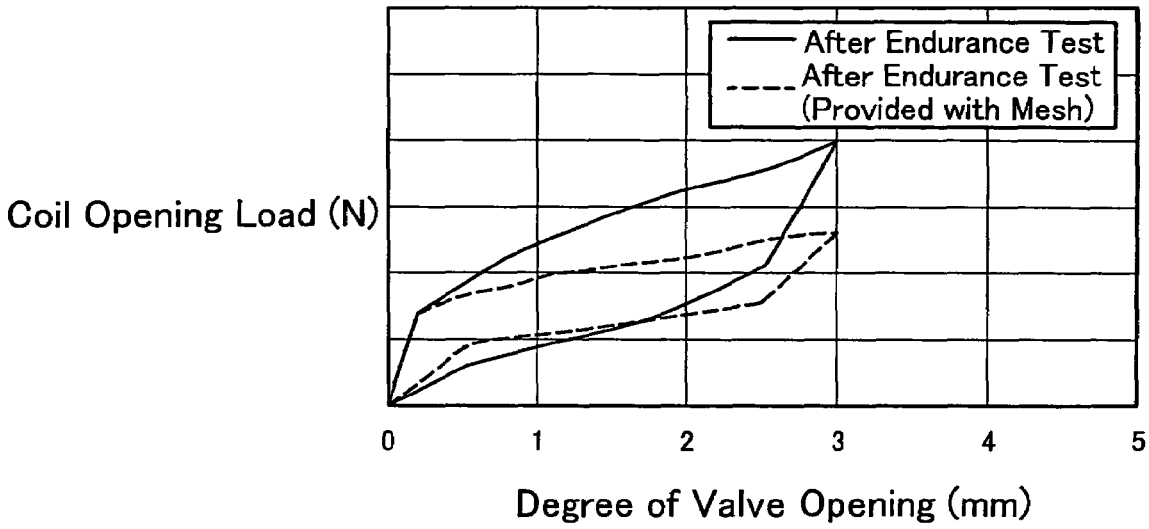
FIG. 22 is a figure for describing another variant of the exhaust passage control valve of the present teachings.

Further, as shown in FIG. 21, metal mesh sheet 86 formed from metal wire net mesh is disposed between helical torsion spring 40 and spring supporting part of valve member 70. With this configuration, the coefficient of friction between the valve member and the helical torsion spring can be kept low, and therefore hysteresis can be suppressed. FIG. 22 shows the hysteresis loop for when metal mesh sheet 86 is provided and for when it is not provided. As is clear from FIG. 22, hysteresis can be reduced by providing metal mesh sheet 86.

Figure 23:
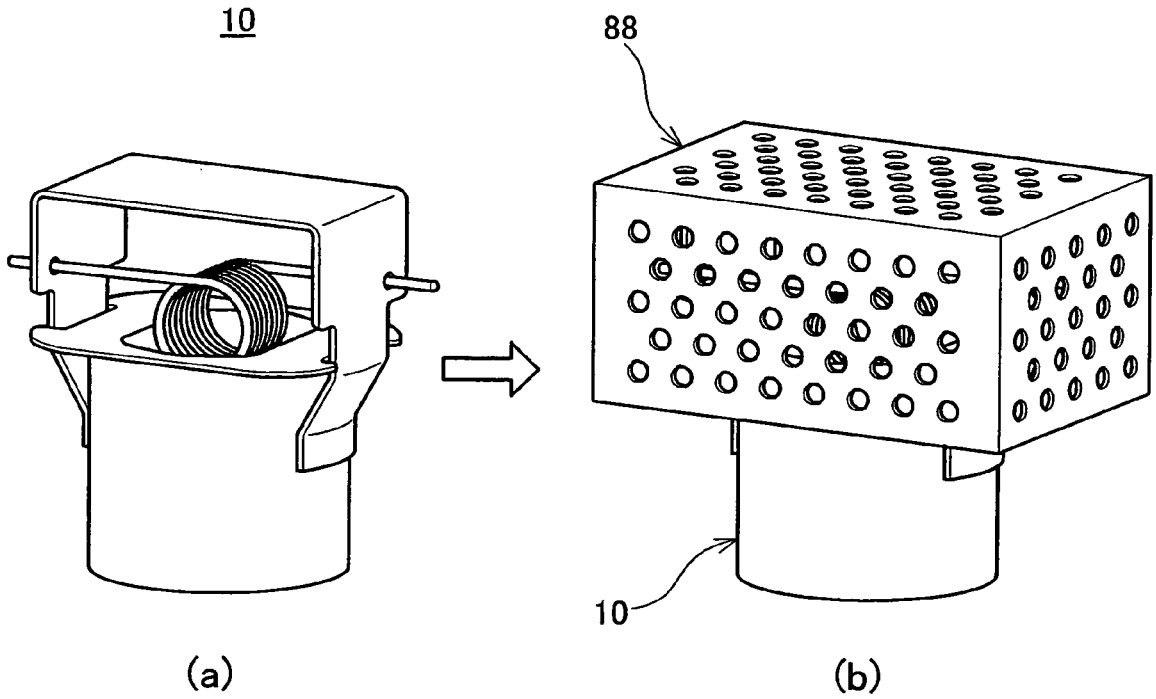
FIG. 23 is a figure for describing another variant of the exhaust passage control valve of the present teachings.
Figure 24:
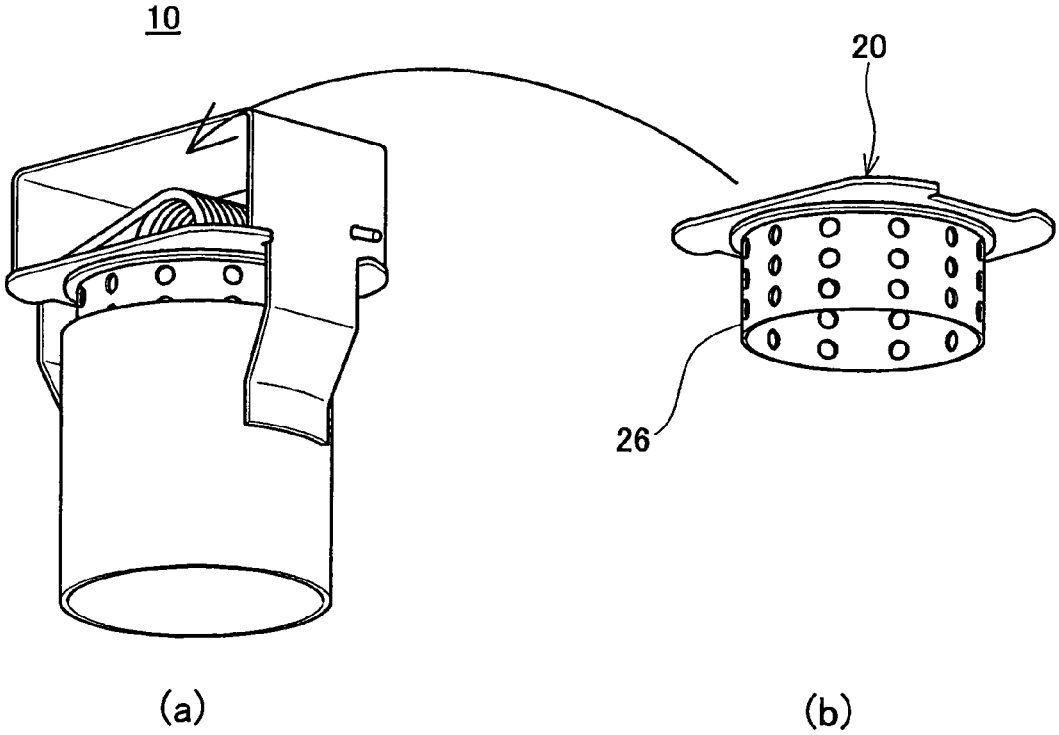
FIG. 24 is a figure for describing another variant of the exhaust passage control valve of the present teachings.
Figure 25:
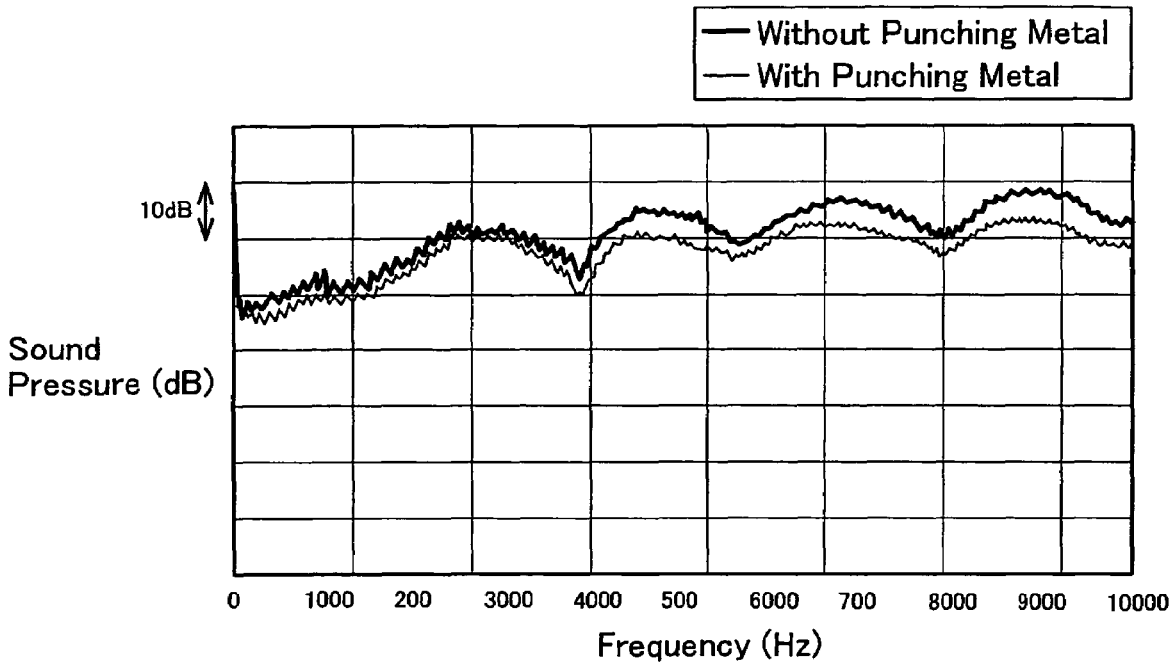
FIG. 25 shows observed flow noise.

Furthermore, it is preferred that the exhaust end side of an exhaust passage control valve 10 is covered by punching metal, as shown in FIG. 23. If the exhaust end side is covered by punching metal, it is possible to reduce flow noise by controlling turbulence of the exhaust gas that is caused when the valve is closed. Moreover, punching metal 26 may also be mounted on valve member 20, as shown in FIG. 24. If the structure shown in FIG. 24 is used, pressure of the exhaust gas is exerted in a uniform manner on valve member 20, and consequently flow noise can be reduced and the valve member can be opened and closed in a stable manner. Further, FIG. 25 shows results measured of the sound pressure when the punching metal is provided and when the punching metal is not provided. As is clear from FIG. 25, high frequency components are reduced by providing the punching metal.

Finally, although the preferred representative embodiment has been described in detail, the present embodiment is for illustrative purpose only and not restrictive. It is to be understood that various changes and modifications may be made without departing from the spirit or scope of the appended claims. In addition, the additional features and aspects disclosed herein also may be utilized singularly or in combination with the above aspects and features.

The invention claimed is:

1. An exhaust passage control valve comprising:

a housing having an exhaust passage through which exhaust gas from an internal combustion engine flows;

a valve member for opening and closing the exhaust passage of the housing when pressure of the exhaust gas flowing through the exhaust passage is equal to or above a predetermined value, the valve member moving with respect to the housing between a closed position and an open position, wherein the valve member closes the exhaust passage when the valve member is in the closed position, and wherein the valve member opens the exhaust passage when the valve member is in the open position;

a helical torsion spring disposed at the opposite side of the valve member from the housing side thereof, the helical torsion spring comprising a coil part wherein spring wires have been wound in a coil shape, and arms formed at both ends of the coil part, the coil part being disposed at approximately the center of the valve member and, when the arms bends with respect to the coil part, the counter-force of this bending energizing the valve member towards a closing side; and a spring mounting member mounted on the housing, the spring mounting member having a guiding part for guiding the valve member, the spring mounting member supporting the arms of the helical torsion spring in a manner allowing the arms to slide in a longitudinal direction of the arms, and the spring mounting member being arranged and constructed to adjust a mounting position in which the spring mounting member is mounted on the housing, wherein a rotation angle of the arms when the valve member is in the closed position is changed by changing the mounting position, and wherein the valve member moves between the closed position and the open position while being guided by the guiding part.

2. An exhaust passage control valve as in claim 1, wherein, when the valve member is disposed in a closed position, the height of an arm mounting position is below an upper face of the coil part and above a lower face of the coil part.

3. An exhaust passage control valve as in claim 2, further comprising a first metal mesh sheet disposed at a sealing face of the housing and the valve member.

4. An exhaust passage control valve as in claim 3, wherein the valve member has a spring supporting part formed at approximately the center of the valve member, the spring supporting part supporting the coil part of the helical torsion spring, and the exhaust passage control valve further comprising a second metal mesh sheet disposed between the coil part and the spring supporting part.

5. An exhaust passage control valve comprising:

a housing having an exhaust passage through which exhaust gas from an internal combustion engine flows;

a valve member for opening and closing the exhaust passage of the housing when pressure of the exhaust gas flowing through the exhaust passage is equal to or above a predetermined value the valve member moving with respect to the housing between a closed position and an open position, wherein the valve member closes the exhaust passage when the valve member is in the closed position, and wherein the valve member opens the exhaust passage when the valve member is in the open position; and a helical torsion spring disposed at the opposite side of the valve member from the housing side thereof, the helical torsion spring comprising a coil part wherein spring wires have been wound in a coil shape, and arms formed at both ends of the coil part, the coil part being disposed at approximately the center of the valve member and, when the arms bends with respect to the coil part, the counter-force of this bending energizing the valve member towards a closing side, wherein the housing has a plurality of spring fitting holes for supporting the arms of the helical torsion spring in a manner allowing the arms to slide with respect to the spring fitting holes, and a rotation angle of the arms when the valve member is in the closed position is changed by changing which of the spring fitting holes the arms are being fitted into, wherein the housing has a guiding part for guiding the valve member, and wherein the valve member moves between the closed position and the open position while being guided by the guiding part.

6. An exhaust passage control valve as in claim 5, wherein, when the valve member is disposed in a closed position, the height of an arm mounting position is below an upper face of the coil part and above a lower face of the coil part.

7. An exhaust passage control valve as in claim 6, further comprising a metal mesh sheet disposed at a sealing face of the housing and the valve member.

8. An exhaust passage control valve as in claim 7, wherein the valve member has a spring supporting part formed at approximately the center of the valve member, the spring supporting part supporting the coil part of the helical torsion spring, and the exhaust passage control valve further comprising a second metal mesh sheet disposed between the coil part and the spring supporting part.

9. A method for manufacturing an exhaust passage control valve as in claim 1, comprising the steps of:

mounting the valve member on the housing;

mounting the arms of the helical torsion spring in the spring mounting member; and fixing the spring mounting member, this having the helical torsion spring mounted therein, to the housing that has the valve member mounted thereon, wherein the fixing step comprises the steps of measuring pressing force exerted on the valve member by the helical torsion spring while the mounting position of the spring mounting member on the housing is changed, and mounting the spring mounting member on the housing at a position where the measured pressing force reaches a predetermined value.

* * * * *